US006824444B2

(12) United States Patent
Huang

(10) Patent No.: US 6,824,444 B2
(45) Date of Patent: Nov. 30, 2004

(54) BRASSIERES

(75) Inventor: Guoxian Huang, Shenzhen (CN)

(73) Assignee: Regina Miracle International Limited, Kwai Chung (HK)

( * ) Notice: Subject to any disclaimer, the term of this patent is extended or adjusted under 35 U.S.C. 154(b) by 0 days.

(21) Appl. No.: 10/170,118

(22) Filed: Jun. 12, 2002

(65) Prior Publication Data

US 2003/0092356 A1 May 15, 2003

(30) Foreign Application Priority Data

Nov. 9, 2001 (HK) ..... 01107880

(51) Int. Cl.[7] ..... A41C 3/00
(52) U.S. Cl. ..... 450/57; 450/41; 450/39
(58) Field of Search ..... 450/57, 1, 39, 450/54, 55, 56, 41, 47, 51, 52, 53, 92, 93; 2/267; 264/257, 258, 292, 324, 325, 327

(56) References Cited

U.S. PATENT DOCUMENTS

| | | | | | |
|---|---|---|---|---|---|
| 4,080,416 | A | * | 3/1978 | Howard | 264/257 |
| 4,148,322 | A | * | 4/1979 | Jacurso et al. | 450/57 |
| 5,967,877 | A | * | 10/1999 | Howard | 450/57 |
| 6,287,168 | B1 | * | 9/2001 | Rabinowicz | 450/75 |
| 6,425,800 | B1 | * | 7/2002 | Huang | 450/41 |

* cited by examiner

*Primary Examiner*—Gloria M. Hale
(74) *Attorney, Agent, or Firm*—Jackson Walker LLP

(57) ABSTRACT

A brassiere includes cups formed of thin plastics material in which each cup is formed with an inner layer and an outer layer that each extend over the surface area of the cup and are joined together around at least substantially the whole periphery of the cup. An elongate strengthener extends across a lower edge of the cup, and an uplifting pad is entrapped between the inner and outer layers. The layers are joined together without stitching adjacent the periphery of the cup to hold the strengthener in position.

6 Claims, 2 Drawing Sheets

BRASSIERES

The invention relates to brassieres.

It is well-known to provide brassieres with cups that are stiffened across a lower edge, traditionally with whale-bone, a plastic strip or metal wire, and cups that a 'fashioned' or padded to some extent to improve the shape or form of breasts when the brassiere is worn. The cups are each usually made of an inner and outer cover (or liner) so as to embrace the 'strengthener' and the padding and to hold them in position. Strong stitching is used conventionally for fixing and holding the strengthener in position which can lead to certain discomfort in use. Relatively strong sticking is used to hold the covers together at or near an upper edge cup seam. The upper seam may also be decorated but in any event causes a visible line across the torso when the brassiere is worn and otherwise completely obscured from view even by or especially by a normal thin outer garment.

It is an object of the invention to overcome or at least reduce these problems.

According to the invention there is provided a brassiere having cups formed of thin plastics material in which each cup is formed with an inner layer and an outer layer that each extend over the surface area of the cup and are joined together around at least substantially the whole periphery of the cup, an elongate strengthener that extend across adjacent a lower edge of the cup, and an uplifting pad entrapped between the inner and outer layers, in which the layers are joined together without stitching adjacent the periphery of the cup to hold the strengthener in position.

Preferably the layers are heat fused together.

Preferably the inner and outer layers each extend from the cups to form at least part of lengths of fused together body and shoulder straps of the brassiere.

Preferably the padding is provided with a fusable adhesive on least parts of its outer surfaces that are fused to the inner and/or outer liners after assembly of the brassiere.

Preferably each liner is formed of thin sponge-backed fabric and joined with the sponge backs joined together.

A brassiere according to the invention will now be described by way of example with reference to the accompanying drawings in which.

Figure 1:
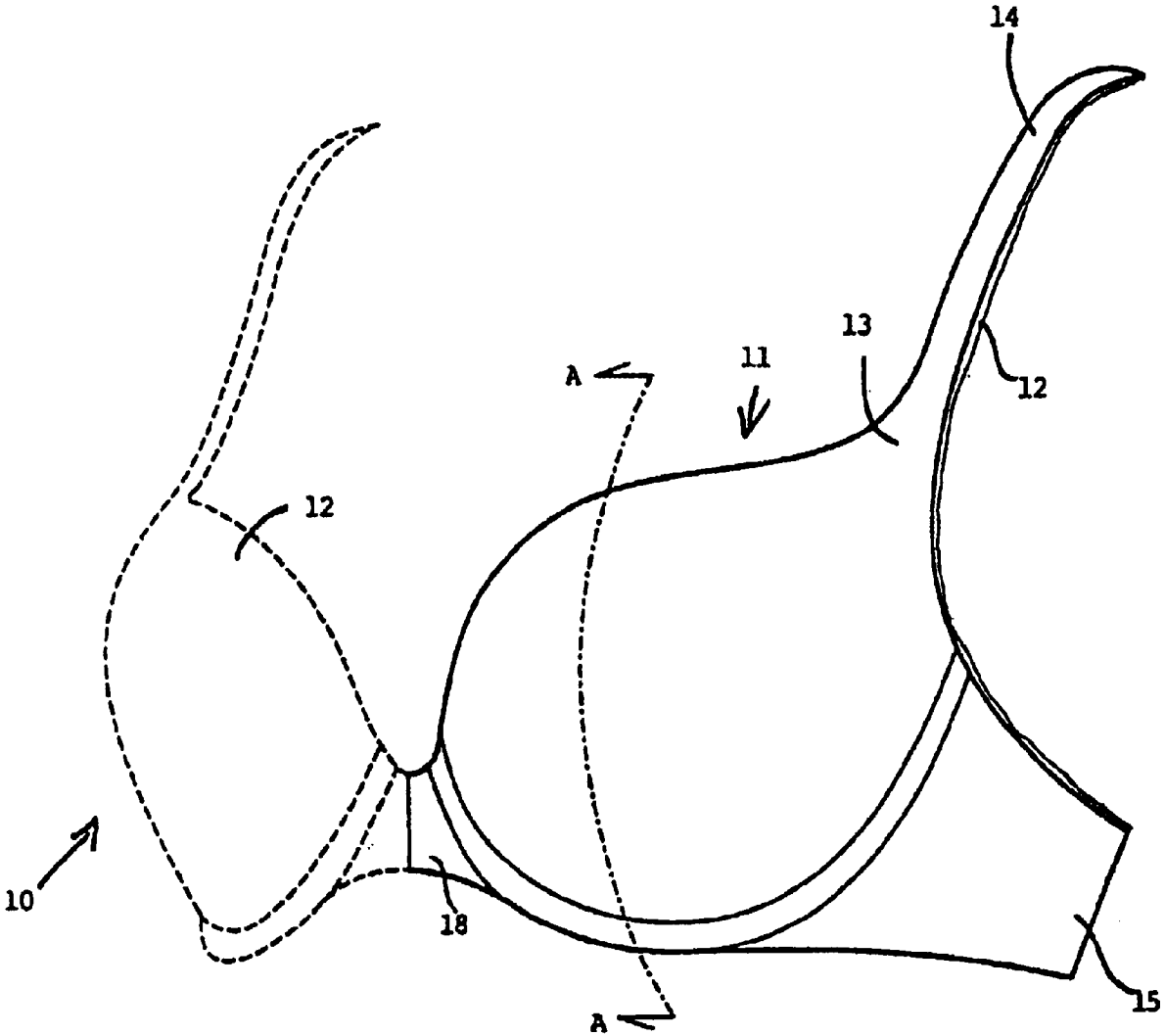
FIG. 1 is an isometric partly disassembled view of the brassiere.

Referring to the drawings, the brassiere has two cups 10 and 11 joined by a centre stabilizer 18 and formed by inner and outer layers 12 and 13. In FIG. 1, the outer layer 13 has been removed from the cup 10. The layers are made of thin sponge backed woven material and joined together with the sponge backings facing one another. The joined-together layers 12 and 13 extend from the cups to form at least part of each shoulder strap 14 and each body strap 15 of the brassiere.

Figure 2:
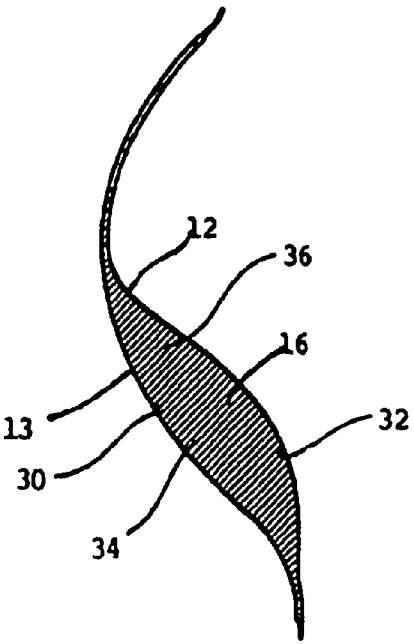
FIG. 2 is a cross-section taken along A—A of FIG. 1.
Figure 3:
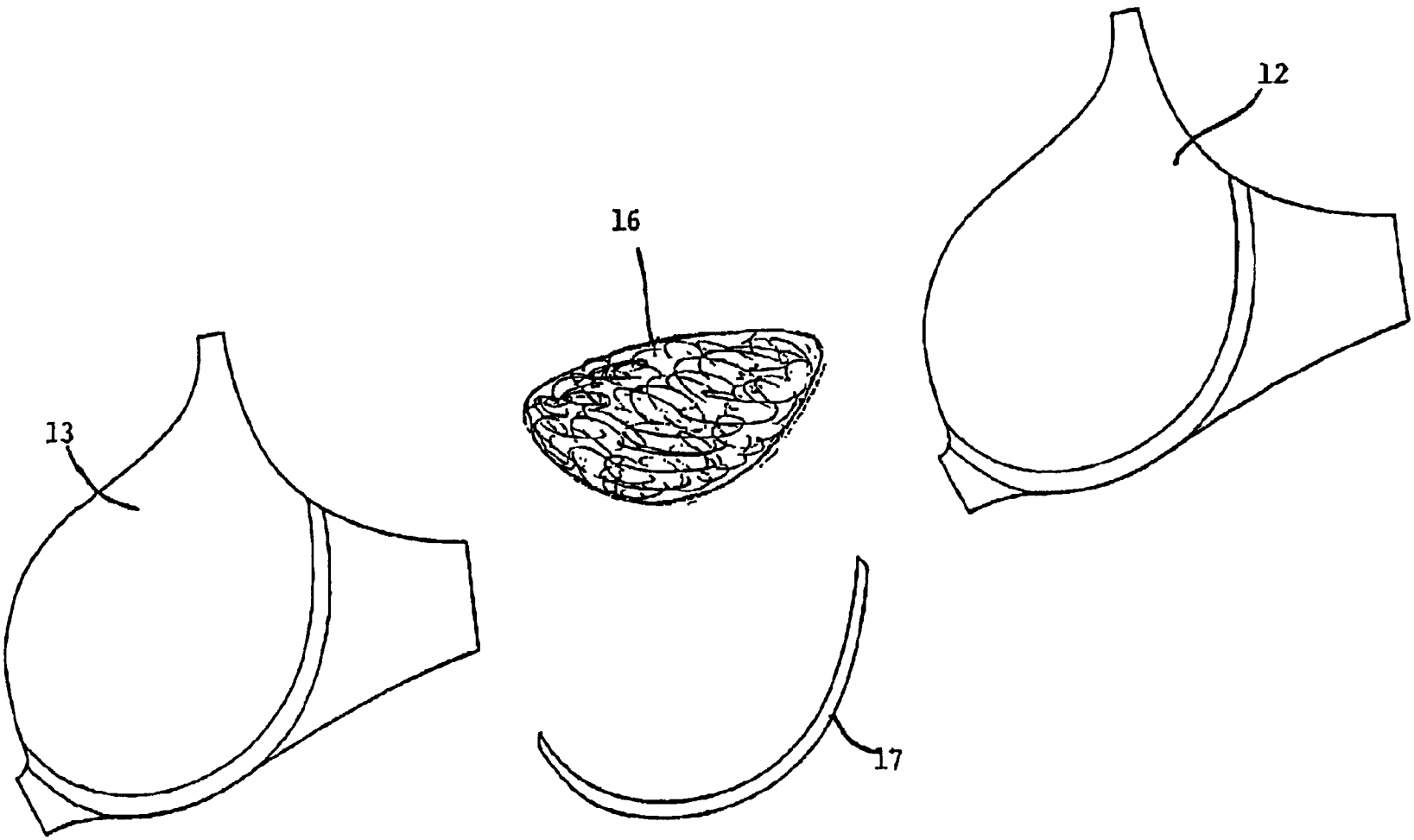
FIG. 3 is an exploded view of principle components of each cup of the brassiere.

There is an uplifting pad 16 in each cup as shown clearly in FIG. 2. The uplifting pad 16 has an outer surface 30 having a convex share conforming to the convex shape of the outer layer 13 of each of the cups 10 and 11 and an inner surface 32 having a sinusoidal shape where the pad 16 is thicker in cross section at a lower portion 34 of the pad 16 than at an upper portion 36. FIG. 3 shows the main components of each cup of the brassiere which include a relatively rigid thin strengthener 17 that fits around a lower edge of each respective cup. The pad 16 may be held loosely between the layers 12 and 13, or pre-fixed to one layer, before the layers are brought together and joined together and around each respective periphery of a cup. This joining together not only fixes the pads 16 in position but also serves to locate and hold the strengtheners along the lower edge of the respective cups.

It will be seen from the Figures that no stitching is used or required and that the exposed edges of the brassiere are very thin. As a result, when the brassiere is worn, in effect no significant artificial edges are created that might be otherwise visible through light-weight or thin outer garments.

The layers 12 and 13 are preferably provided with heat fusable sponge backings or with a covering of heat fusable glue. This enables the joining of the layers to be carried out by applying heat of the brassiere when first assembled together. Normally, the layers are pre-cut to the required shape, including the cups and the straps, but edges around the cups and sides of the straps may be trimmed by cutting if required or preferred, after a heat fusing operation.

The brassiere might be manufacture using a heat press to fix the layers together. Initially, the strengthener 17 is formed by placing a wire into a wire channel which is sewn together. The strengtheners 17 are then mounted to the inner layer 12. The edges of the layer 12 are then sprayed with adhesive. The uplifting pads 16 can be mounted upon the inner layer either before or after the application of adhesive.

The outer layer 13 is then mounted over the uplifting pad and strengthener with its periphery coinciding with the periphery of the inner layer. The layers are then pressed together in a heat press to fix the adhesive around the perimeter. Excess material can then be trimmed.

The inner and outer layers can be formed of nylon spandex or cotton LYCRA® synthetic fibers or polyester LYCRA® synthetic fibers.

The foam backing can be 1 mm polyester foam or any other material displaying desirable softness characteristic. This material might be thicker or thinner depending upon application. As an example, the material might be normal foam or non-yellowing foam.

The wire in the strengthener might be metal and the wire casing might be nylon spandex. The wire casing covers the wire as the strengthener. The uplifting pad 16 might be formed of foam, oil sack, foam cookies for example. However, other suitable compliant material may be 4 chosen. The centre stabilizer 18 might be formed of terrycloth fabric, polyester, nylon or other suitable material.

What is claimed is:

1. A brassiere having cups formed of thin plastics material in which each cup is formed with an inner layer and an outer layer joined together around at least substantially the entire outer periphery of each of the cups, an elongate strengthener that extends adjacent to a lower edge of each of the cups, and an uplifting pad entrapped between the inner and outer layers, the uplifting pad has an outer surface having a convex shape conforming to the convex shape of the outer layer of each of the cups and an inner surface having a sinusoidal shape wherein the pad is thicker in cross section at a lower portion of the pad than at an upper portion, and in which the layers are joined together without stitching adjacent to the outer periphery of each of the cups without stitching to hold the strengthener in position.

2. A brassiere according to claim 1, in which the layers are heat fused together.

3. A brassiere according to claim 2, in which the inner and outer layers each extend from the cups to form at least part of lengths of fused together body and shoulder straps of the brassiere.

4. A brassiere according to claim 1, in which the padding is provided with a fusable adhesive on at least parts of its outer surfaces that are fused to the inner and/or outer after assembly of the brassiere.

5. A brassiere according to claim 1, in which each layer is formed of thin sponge-backed fabric and joined with the sponge backs joined together.

6. A brassiere according to claim 3 in which the padding is provided with a fusable adhesive on at least parts of its outer surfaces that are fused to the inner and/or outer layers after assembly of the brassiere.

* * * * *